United States Patent [19]

Yano et al.

[11] Patent Number: 4,946,516

[45] Date of Patent: Aug. 7, 1990

[54] PROCESS FOR PRODUCING HIGH TOUGHNESS, HIGH STRENGTH STEEL HAVING EXCELLENT RESISTANCE TO STRESS CORROSION CRACKING

[75] Inventors: Seinosuke Yano; Yoshihiro Okamura; Hirohide Muraoka, all of Kitakyushu, Japan

[73] Assignee: Nippon Steel Corporation, Tokyo, Japan

[21] Appl. No.: 321,199

[22] Filed: Mar. 8, 1989

[30] Foreign Application Priority Data

Mar. 8, 1988 [JP] Japan ..... 63-52726

[51] Int. Cl.[5] ..... C21D 8/02

[52] U.S. Cl. ..... 148/12 F; 148/12 C; 148/12.4

[58] Field of Search ..... 148/12 F, 12 C, 12.4

[56] References Cited

FOREIGN PATENT DOCUMENTS

| | | | |
|---|---|---|---|
| 100214 | 6/1984 | Japan . | |
| 60-177128 | 9/1985 | Japan | 148/12 F |
| 127815 | 6/1986 | Japan . | |
| 272316 | 12/1986 | Japan . | |
| 63-223124 | 9/1988 | Japan | 148/12 F |

*Primary Examiner*—Deborah Yee

*Attorney, Agent, or Firm*—Wenderoth, Lind & Ponack

[57] ABSTRACT

A process for producing steel possessing a high level of toughness and strength free of anisotropy and having good resistance to stress corrosion cracking in seawater conditions comprises the steps of:

preparing a steel slab comprised of 0.02 to 0.10 wt % C, 0.50 wt % or less Si, 0.4 to 1.5 wt % Mn, 1.0 to 8.0 wt % Ni, 0.1 to 1.5 wt % Mo, 0.8 wt % or less Cr, 0.01 to 0.08 wt % sol. Al, with the balance of Fe and unavoidable impurities;

heating the slab to a temperature of from 1000° C. to 1250° C.;

hot rolling the steel at a reduction rate of 20 to 60% at an austenite recrystallization temperature region and then at a reduction rate of 30 to 70% at an austenite nonrecrystallization temperature region and finishing the rolling at a temperature of 650° C. or higher;

quenching the steel by initiating water cooling at a temperature at or above the $A_{r3}$ point thereof and terminating the water cooling at a temperature of 150° C. or lower;

quenching the steel after reheating the steel to a temperature between the $A_{c3}$ point and the $A_{c3}$ point+100° C. thereof; and tempering the steel at a temperature at or below the $A_{c1}$ point thereof.

4 Claims, 3 Drawing Sheets

PROCESS FOR PRODUCING HIGH TOUGHNESS, HIGH STRENGTH STEEL HAVING EXCELLENT RESISTANCE TO STRESS CORROSION CRACKING

BACKGROUND OF THE INVENTION

1. Field of the Invention

The present invention relates to a process for producing high toughness, high strength steel having excellent resistance to stress corrosion cracking in a stress-corrosive environment such as seawater or salt water. 2. Description of the Prior Art The growing energy demand of recent years and the need to secure stable supplies of energy have led to a rapid heightening of interest in the development of seabed resources and geological surveys of the seabed. In turn, this has also stimulated the construction of marine structures and seabed research vessels related to such ocean development, and to the construction of seabed bases for oil production and other such purposes.

With these structures needing to be free from distortion, failure, and so forth caused by waves and water pressure, ensuring higher levels of safety is an urgent task. As such, it is required that materials used for such structures have high weldability, high strength, and high toughness, and that they also have high resistance to stress corrosion cracking under service environment conditions such as seawater.

To meet the need for safer, more reliable steel, high strength, low alloy, Ni-containing steels and processes for producing such steels have been developed.

In Japanese Unexamined Patent Publication No. 61-127815, a steel slab is heated at a very low temperature, 900° C. to 1000° C., and is then subjected to low temperature hot rolling and direct quenching, followed by tempering, with the result that the effective grain size is defined to provide a high toughness steel with a higher brittle crack arresting capability than conventional steels.

In Japanese Unexamined Patent Publication No. 59-100214, uniform mechanical properties are imparted to a steel plate by suppressing fluctuation along the length by simultaneously cooling the entire steel plate and by suppressing fluctuation in the thickness direction by reducing the water flow density to minimize the difference in cooling rate between the surface and the interior of the steel plate.

However, none of these disclosures consider stress corrosion in an environment in which there is contact with salt water, such as in the case of marine structures, and thus cannot be considered to be entirely safe for marine use.

Japanese Unexamined Patent Publication No. 61-272316 discloses a process for producing steel having good resistance to stress corrosion cracking in seawater, wherein Ni-containing steel with added Nb and reduced amounts of the impurity elements P, N, and O is hot-rolled and then subjected to direct quenching and tempering.

U.S. Patent Application Ser. No. 120,315/87 discloses improving the resistance to stress corrosion cracking of welded portions by reducing the carbon in a Ni-Mo steel and making up for the drop in strength caused by the lower carbon by utilizing controlled rolling, direct quenching and tempering.

To study stress corrosion cracking in high strength steels, use is made of the linear fracture mechanics mode theory, in which the stress intensity factor (K value) is applied to quantize the fracture behavior of cracks or defects inherent in the material in a corrosive environment. For this, a pre-cracked specimen is subjected to a stress corrosion cracking test under the conditions of the service environment to establish a severe condition at the notch root and accelerate the onset of delayed failure.

For this, a set of constant-load tests at various K levels is performed under the above conditions to obtain the critical $K_{ISCC}$ value (Mode I fracture occurring under plain strain condition), a constant K value at or below which failure does not take place. This $K_{ISCC}$ value is utilized to evaluate the resistance to stress corrosion cracking.

SUMMARY OF THE INVENTION

The object of the present invention is to provide a process for producing high toughness, high strength steel having excellent resistance to stress corrosion cracking in a stress-corrosive environment such as seawater or salt water.

DETAILED DESCRIPTION OF THE INVENTION

Figure 1A:
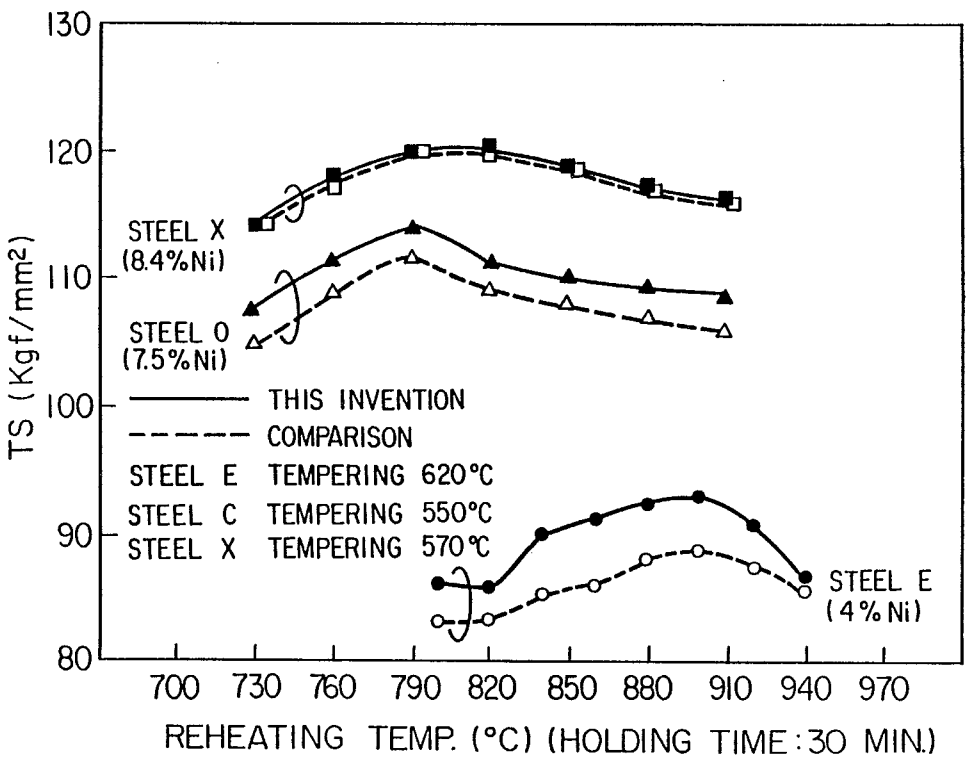
FIGS. 1A and B are graphs showing a comparison of the strengthening effect produced by reheating in the case of an ordinary rolling process consisting of hot rolling followed by air cooling, and that obtained with the process according to the present invention, consisting of hot rolling followed by water cooling.

The present inventors carried out various studies with respect to the development of a Ni-containing low-alloy steel having good weldability, good resistance to stress corrosion cracking in seawater or salt water, and high strength and toughness with no anisotropy (differences between strength and toughness values measured longitudinal to the rolling direction and those measured transverse to the rolling direction). As a result, it was discovered that the carbon content had a marked effect on the resistance to stress corrosion cracking of high strength steel, and that reducing the carbon content is extremely effective. It was also found that although low-carbon Ni-containing steel subjected to the normal process of rolling, quenching and tempering results in a parent metal virtually free of anistropy and having a sufficiently high $K_{ISCC}$ value, the strength of the steel falls short of the target level. On the other hand, although high strength can be obtained through the use of controller rolling, direct quenching and tempering, such steel exhibits pronounced anistropy, which produces a slight drop in the $K_{ISCC}$ value of the parent metal.

To examine the behavior of carbides, following controlled rolling, direct quenching and tempering, the steel was subjected to reheating, quenching and tempering at various austenitizing temperatures. As a result, it was found that at certain temperature regions steel was obtained having a markedly higher strength, virtually no anistropy, good toughness, and wherein the parent metal and welded portions exhibited a sufficiently high $K_{ISCC}$ value. The results of a detailed investigation into this increase in toughness are described in the following.

(1) In the heat treatment of steel containing Ni and Mo as main alloying elements consisting of the steps of hot rolling the steel followed by direct quenching and reheating, in steel plate heated at temperature regions at which both $\alpha$ phase and $\gamma$ phase coexist, agglomerate austenite forms at the old austenite grain boundaries, while within the grains mainly groups of acicular austenite grains form, and Mo-containing cementite, Mo alloy carbides and ferrite coexist. Because the acicular austenite grains are formed by a martensitic reverse transformation ($\alpha$ to $\gamma$), they have large numbers of transformation dislocations When the steel is heated to a higher temperature of between the $A_{c3}$ point and the $A_{c3}$ point +100° C., ferrite beaks down and small amounts of undissolved carbides remain, and acicular austenite grains start to come together and form agglomerations. However, even at this high temperature region a high dislocation density is maintained, and quenching at this point will lead to further increases in the quantities of dislocations. The result is that a very high quench hardness is obtained. At temperatures over the $A_{c3}$ point +100° C. there is a rapid fall-off in dislocation density, and the quench hardness also decreases.

(2) If in addition the steel is tempered at a temperature below the transformation point $Ac_1$, the result is a markedly high strength and toughness that is proportional to the quench hardness.

(3) The increase in toughness described above is manifested more clearly when the main structure prior to reheating is a martensite or martensite and lower bainite structure rather than an upper bainite or ferrite and pearlite structure. Also, the finer the grain the more pronounced the effect is. Because of this, in the case of steel rolled by the usual process that has a non-quenched structure, high toughness, high strength steel can be obtained by subjecting the rolled plate to direct quenching to form the main structure into martensite or martensite and lower bainite.

It was found that high strength, high toughness steel having good uniformity, good weldability and good resistance to stress corrosion cracking could be produced by the controlled hot rolling of low carbon, Ni-containing low alloy steel followed by direct quenching, reheating, quenching and tempering under an appropriate set of conditions.

Based on these findings, the present invention comprises the steps of:

preparing a steel slab constituted of 0.02 to 0.10 wt% C, 0.50 wt% or less Si, 0.4 to 1.5 wt% Mn, 1.0 to 8.0 wt% Ni, 0.1 to 1.5 wt% Mo, 1.0 wt% or less Cr, 0.01 to 0.08 wt% sol. Al, and the balance of Fe and unavoidable impurities; with the further inclusion of one or more of: 1.5 wt% or less Cu, 0.12 wt% or less V, 0.04 wt% or less Nb, 0.015 wt% or less Ti; and/or 0.0050 wt% or less Ca;

heating the steel to a temperature of from 1000° C. to 1250° C.;

hot rolling the steel at a reduction rate of 20 to 60% at a temperature region at which austenite recrystallizes and at a reduction rate of 30 to 70% at a temperature region at which austenite does not recrystallize, and finishing the rolling at a temperature of 650° C. or higher; and following this by quenching the steel by initiating water cooling at a temperature at or above the $A_{r3}$ point thereof and terminating the water cooling at a temperature of 150° C. or lower;

further quenching the steel after reheating at a temperature region between the $A_{c3}$ point and the $A_{c3}$ point + 100° C; and tempering at a temperature at or below the $A_{c1}$ point.

First, the reasons for the above limitations on the component elements of the steel will be described.

Carbon is useful for increasing the strength by improving the hardenability. At the same time, carbon also has the strongest influence on the improvement of the resistance to stress corrosion cracking which is an essential object of the present invention. Over 0.10 wt% carbon produces a marked drop in the resistance to stress corrosion cracking, i.e., the $K_{ISCC}$ value and a sharp increase in the hardness of the heat affected zone, while a carbon content below 0.02 wt% is insufficient to provide the required strength. Hence, a carbon content of 0.02 to 0.10 wt% is specified.

Silicon is effective for increasing the strength but with Ni-containing steels too much silicon increases temper brittleness, which decreases the cryogenic toughness. Therefore, to ensure sufficient strength and to prevent a drop in the notch toughness, an upper limit of 0.50 wt% Si is specified.

By increasing the hardenability, manganese ensures strength and toughness but, like silicon, too much manganese increases temper brittleness. The lower limit of 0.4 wt% Mn is specified to ensure the strength and toughness and the upper limit of 1.5 wt% to prevent temper brittleness.

Nickel increases the stacking fault energy, promoting cross slip and producing stress relaxation and a resulting increase in the absorbed impact energy. Nickel also improves the strength by enhancing the hardenability. The nickel content is generally selected in accordance with the desired strength and toughness of the steel concerned. In the steel according to the present invention, this means 1.0 wt% or more Ni for a balance with the other component elements. However, when the nickel content exceeds 8.0 wt%, in nearly every case the main structure of the steel plate becomes more hardened than lower bainite, making direct quenching after rolling unnecessary. This can be understood from the experimental results shown in FIG. 1.

Molybdenum improves the hardenability, ensuring the strength, and prevents temper brittleness. Molybdenum is particularly effective because it expands the nonrecrystallization temperature region of the steel. In the present invention, molybdenum also has the effect of suppressing coarsening of the acicular austenite grains and sustaining a high dislocation density. However, with a molybdenum content below 0.1%, the above effects will be too small to enable the required strength and toughness to be achieved, while more than 1.5 wt% will increase the amount of coarse carbide particles such as $Mo_2C$, reducing toughness and producing a marked hardening of the HAZ.

Chromium improves the hardenability, thus ensuring the strength, but must be limited to an amount of 0.80 wt% or less since more may increase the hardness of the HAZ, lowering the $K_{ISCC}$ value.

Sol. Al is an effective constituent for the formation of nitrides and the refining of austenite grains at high temperature regions during the heating and heat treatment of the steel. As this effect is slight with less than 0.01 wt%, while more than 0.08 wt% sol. Al causes an increase in the amount of aluminate inclusions, reducing the toughness, a range of 0.01 to 0.08 wt% was specified.

The above are the basic component elements of the steel according to the present invention. The following elements can be selectively used as additives to further improve the strength and the toughness.

In amounts up to 1.5 wt% copper provides increased strength and improved corrosion resistance without reducing the toughness; more may impair the hot workability, and can lead to cracking during the rolling process.

Vanadium ensures the strength of the steel by precipitating carbonitrides formed during tempering and can be added in an amount up to 0.12 wt%; in larger amounts it impairs the toughness.

Niobium mainly expands the nonrecrystallization temperature region, enhancing the grain refinement effect of controlled rolling, but during reheating it is also useful for refining the size of austenite grains, which ensures toughness. Too much Nb hardens the HAZ, reducing the resistance to stress corrosion cracking, so a limit of 0.04 wt% is specified.

Titanium is effective for preventing grain coarsening at welded portions, for which it can be added in amounts up to 0.015 wt%; more will impair the toughness of the parent metal.

The above additives enhance the strength and the toughness, while anisotropy and anti-lamellar tearing properties are improved by the addition of calcium. Calcium is extremely effective for spheroidizing nonmetallic inclusions, thereby improving the toughness and reducing anisotropy in the toughness. A calcium limit of 0.0050 wt% or less has been specified as exceeding this amount will produce a lowering of the toughness owing to an increase in the amount of inclusion.

As phosphorus, sulfur, nitrogen, and other impurities impair the toughness which is a characteristic of the steel according to the present invention, the amounts of such impurities should be reduced as much as possible. Preferably, phosphorus should be controlled to 0.010 wt% or less, sulfur to 0.005 wt% or less, and nitrogen to 0.006 wt% or less.

The present invention further comprises the steps of: heating a steel slab having the composition described above to a temperature of from 1000° C. to 1250° C.; hot rolling the steel at a reduction rate of 20 to 60% at a temperature region at which austenite recrystallizes and at a reduction rate of 30 to 70% at a temperature region at which austenite does not recrystallize, and finishing the rolling at a temperature of 650° C. or higher; followed by quenching of the steel by initiating water cooling at a temperature at or above the $A_{c3}$ point thereof and terminating the water cooling at a temperature of 150° C. or lower; further quenching the steel after reheating at a temperature region between the $A_{c3}$ point and the $A_{c3}$ point 100° C.; then tempering at a temperature at or below the $A_{c1}$ point.

The reason for the limitations in these steps will now be described.

The steel slab may be prepared either by continuous casting or by ingot-casting and slabbing. Prior to the following heating step, if required the slab may be subjected to pre-treatment consisting of iterations of a heating and cooling cycle to diffuse elements which have a tendency to segregate.

In the heating at a temperature of from 1000° C. to 1250° C., carbonitrides of Mo, V, and the like present in the steel slab must be sufficiently dissolved in the solid solution in order to utilize the strengthening effect provided by the refinement of heated austenite grains and by the precipitation during tempering of fine carbonitride particles of elements such as, for example, Mo and V. Dissolution cannot be effected sufficiently at a heating temperature below 1000° C., and the presence of undissolved precipitates such as $M_6C$ causes insufficient precipitation hardening during tempering and a drop in the toughness.

Conversely, while a heating temperature above 1250° can provide sufficient dissolution of carbonitrides of Mo, V and the like, it increases oxide formation on the surface of the steel, resulting in surface defects in the rolled plate. The higher temperature also coarsens the heated austenite grains, and as these grains cannot easily be refined during the subsequent rolling, it causes a drop in the toughness. Taking these points into consideration, 1000° C. to 1250° C. has been specified as the heating temperature of the slab.

The slab that has been heated to a temperature of from 1000° C. to 1250° C. is then rolled at a reduction rate of 20 to 60% at a temperature region at which austenite recrystallizes and at a reduction rate of 30 to 70% at a temperature region at which austenite does not recrystallize, and the rolling is finished at a temperature of 650° C. or higher. The reasons for the above rolling condition limitations will now be described.

As has been mentioned, to manifest the increased strength provided by maintaining a high dislocation density, which forms the gist of the present invention, it is necessary to refine the size of the grains and form the texture prior to reheating into a quench-hardened texture. It is for this reason that in accordance with the present invention controlled rolling and direct quenching are employed.

If, with the object of obtaining fine austenite grains, the total reduction rate in the rolled austenite recrystallization temperature is lowered, that is, high total reduction rate rolling is carried out at a so-called nonrecrystallization temperature that is around 880° C. or less, the result is excessive formation of fine, elongated austenite grains. In turn, this produces a marked increase in toughness and strength anisotropy, making the material more prone to resistance to stress corrosion cracking.

On the other hand, when rolling is carried out at a high total reduction rate in recrystallization temperature regions and a low total reduction rate in nonrecrystallization temperature regions, there is insufficient formation of elongated fine austenite grains and deformation bands, which results in a drop in the toughness and a lack of sufficient strength owing to an insufficiency of precipitation hardening. For this reason, it has been specified that at a recrystallization temperature region a total reduction rate of between 20% and 60% is required, and preferably a rate between 30% and 60%; while at a nonrecrystallization temperature region the rate is preferably between 70% and 30%, and more preferably between 60% and 30%.

The reason for specifying that the finishing temperature must be 650° C. or higher is to ensure that the temperature at which direct quenching is initiated is higher than the $Ar_3$ point. The quenching may be done immediately after the completion of the rolling when the quenched structure is to be martensite throughout the plate thickness. In other cases, however, since the quenched structure and the as-quenched hardness will be unstable owing to residual hot working strain and the resulting rise in the transformation point, a transfer time of a certain duration should be used prior to the initiation of the water cooling. An excessive transfer time, however, will allow the temperature of the steel to fall below the transformation point. Hence, 15 to 150 sec is given as a suitable transfer time.

To get a sufficiently hardened structure, quenching is done by initiating water cooling at or above $A_{r3}$ transformation temperature after finishing the rolling and terminating the water cooling at a temperature at or below 150° C. A water cooling temperature higher than 150° C. may result in an incomplete martensitic transformation and retainment of untransformed austenite, thereby lowering the yield strength of the steel plate.

Direct quenching according to the present invention may be effected either in a static manner wherein the whole of the plate is cooled simultaneously, or in a continuous manner whereby the steel is cooled linearly starting with the part that first enters the cooling system. The cooling water flow density is not particularly critical, so the cooling equipment may be used at full capacity. This is advantageous in that it enables the line processed tonnage per unit time to be increased, with a resulting reduction in costs.

After the steel has been rolled and water cooled, it is reheated at an appropriate temperature within the range between the $A_{c3}$ point and the $A_{c3}$ point +100° C. thereof, then quenched.

The preservation of the high dislocation density in the acicular austenite formed by the martensite reverse transformation ($\alpha$ to $\gamma$) is central to the present invention, but at temperatures over the $A_{c3}$ +100° C. dislocation density drops rapidly and the quench hardness also decreases. Also, large quantities of dislocations introduced along with the formation of deformation bands during rolling in unrecrystallization temperature regions are solidified by the following direct quenching. Although some remain even when heated to a high temperature in the course of the reheating, reheating at temperatures over $A_{c3}$ +100° C. sharply decreases the amount. Austenite remains at low temperatures below the $A_{c3}$ point and dislocation density does not increase.

This reheating brings about a partial recrystallization and the destruction of a large part of the extended austenite grain boundaries, which produces a marked improvement in toughness and strength anisotropy, and resistance to stress corrosion cracking.

Figure 1B:
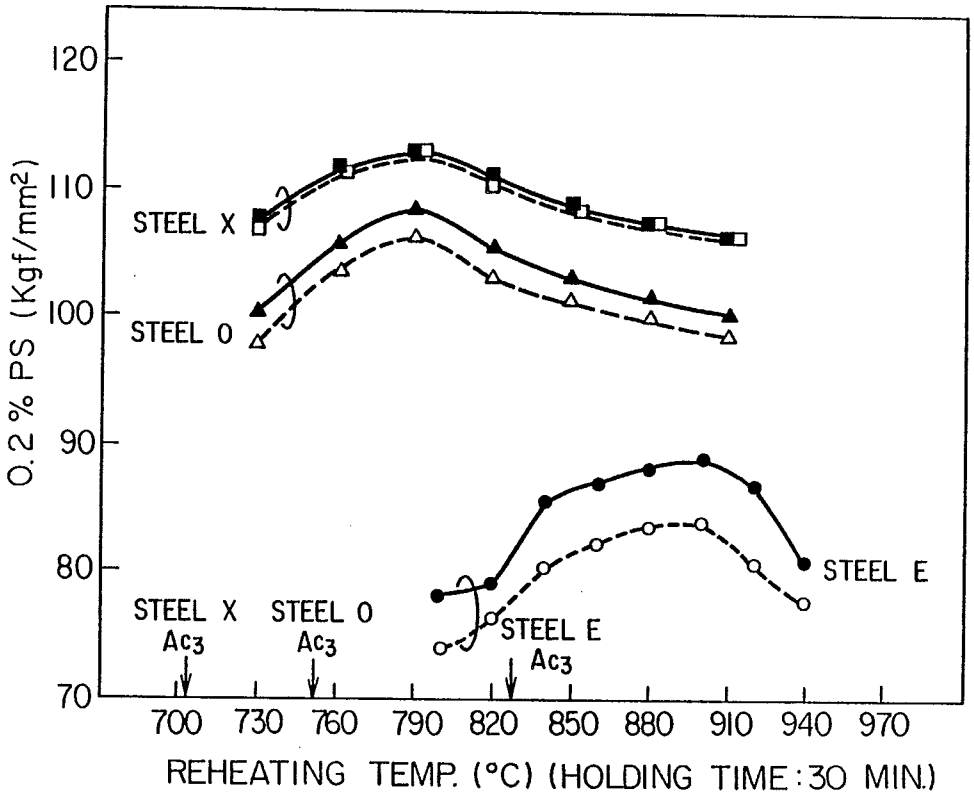

FIGS. 1A and 1B show this type of strengthening effect produced by reheating, compared with an ordinary rolling process consisting of hot rolling followed by air cooling. The graphs show clearly how pronounced the effect is with the process of controlled rolling and direct quenching followed by water cooling according to the present invention.

Figure 2:
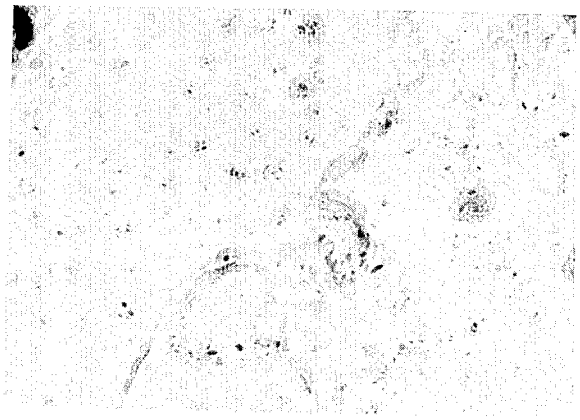
FIG. 2 is a photograph showing (at a magnification of ×150,000) the state of carbonitride precipitation in reheated material according to the present invention.

FIG. 2 is a ×150,000 enlargement of an electron microphotograph of a state of carbonitride precipitation in steel that has been reheated and quenched.

As has been described in the above, this reheating step forms one of the essential constituent elements of the present invention, along with the steps of controlled rolling and direct quenching.

Following the reheating-quenching, the steel has to be tempered to at a temperature that is at or below the $Ac_1$ point. Exceeding the $Ac_1$ point will give rise to unstable austenite, and a consequent degradation in toughness. This being the case, the $Ac_1$ point has been specified as the upper limit for the temper temperature, in order to obtain sufficient precipitation hardening of the elements such as Mo and V that form the carbonitrides and provide the required strength and toughness.

This type of production process can provide steel that, notwithstanding its low carbon, possesses high strength and high toughness, and a remarkably improved $K_{iscc}$.

Examples

Steel slabs having the compositions shown in Table 1 were formed into steel plates ranging in thickness from 40 mm to 130 mm, using the inventive and comparative conditions listed in Table 2. The parent metal of the plates was subjected to mechanical tests and the $K_{isec}$ values of the parent metal and of HAZs were investigated. Welding was performed by, for example, TIG welding and submerged arc welding at a heat input ranging from 25 to 50 kJ/cm.

Table 1 lists the chemical compositions of the steels; Table 2 the production conditions; and Table 3 the results of tests on the mechanical properties imparted to the steels by the production conditions listed in Table 2, and the results of the $K_{iscc}$ tests which were performed using test pieces in 3.5% artificial seawater in accordance with the test method specified by ASME E399.

Steels V, W and X listed in Table 1 have compositions that fall outside the ranges specified according to the present invention.

The $Ac_3$ transformation point values listed in Table 1 are taken from page 52 of Tetsu to Hagane, No. 11, 1965, "Relationship between chemical composition and transformation point in low carbon, low alloy steel."

TABLE 1

| | | (wt %) | | | | | | | | | | | | | | | | | |
|---|---|---|---|---|---|---|---|---|---|---|---|---|---|---|---|---|---|---|---|
| | Steel | C | Si | Mn | Ni | Mo | Cr | Sol.Al | Cu | V | Nb | Ti | Ca | P | S | N | Ceq | Pcm | $Ac_3$ |
| Invention | A | 0.08 | 0.08 | 0.47 | 1.23 | 1.25 | 0.76 | 0.048 | — | — | — | — | — | 0.005 | 0.001 | 0.0045 | 0.65 | 0.25 | 915 |
| | B | 0.06 | 0.10 | 0.80 | 3.51 | 0.66 | 0.53 | 0.051 | — | — | — | — | — | 0.003 | 0.001 | 0.0030 | 0.56 | 0.23 | 838 |
| | C | 0.07 | 0.22 | 0.65 | 5.10 | 0.47 | 0.68 | 0.035 | — | — | — | — | — | 0.005 | 0.002 | 0.0035 | 0.57 | 0.26 | 789 |
| | D | 0.05 | 0.05 | 0.58 | 7.30 | 0.86 | 0.55 | 0.028 | — | — | — | — | — | 0.008 | 0.002 | 0.0028 | 0.66 | 0.29 | 746 |
| | E | 0.07 | 0.26 | 0.69 | 3.95 | 0.46 | 0.64 | 0.030 | — | 0.056 | — | — | — | 0.005 | 0.002 | 0.0025 | 0.54 | 0.25 | 827 |
| | F | 0.06 | 0.07 | 1.31 | 2.52 | 0.50 | 0.44 | 0.032 | 1.05 | — | — | — | — | 0.009 | 0.001 | 0.0036 | 0.56 | 0.28 | 826 |
| | G | 0.04 | 0.08 | 0.58 | 5.35 | 0.55 | 0.50 | 0.029 | — | — | — | 0.013 | — | 0.009 | 0.001 | 0.0030 | 0.51 | 0.22 | 795 |
| | H | 0.08 | 0.22 | 0.98 | 1.05 | 0.64 | 0.76 | 0.032 | 0.35 | 0.082 | — | — | — | 0.004 | 0.003 | 0.0032 | 0.60 | 0.26 | 896 |
| | I | 0.07 | 0.15 | 0.85 | 2.68 | 0.60 | 0.68 | 0.036 | — | 0.063 | 0.025 | — | — | 0.007 | 0.001 | 0.0042 | 0.56 | 0.24 | 859 |
| | J | 0.06 | 0.25 | 0.52 | 5.72 | 0.57 | 0.75 | 0.050 | 0.30 | 0.045 | — | 0.010 | — | 0.004 | 0.001 | 0.0038 | 0.60 | 0.28 | 790 |
| | K | 0.05 | 0.06 | 0.57 | 7.84 | 0.90 | 0.53 | 0.040 | 0.15 | 0.052 | 0.015 | 0.008 | — | 0.008 | 0.002 | 0.0040 | 0.68 | 0.31 | 742 |
| | L | 0.06 | 0.28 | 1.10 | 4.12 | 0.40 | 0.68 | 0.028 | — | — | — | — | 0.0032 | 0.008 | 0.003 | 0.0021 | 0.59 | 0.25 | 811 |
| | M | 0.07 | 0.22 | 0.53 | 3.61 | 0.70 | 0.56 | 0.043 | — | — | — | — | 0.0038 | 0.008 | 0.003 | 0.0042 | 0.54 | 0.24 | 842 |
| | N | 0.05 | 0.06 | 0.58 | 6.95 | 0.49 | 0.55 | 0.030 | — | — | — | — | 0.0045 | 0.005 | 0.004 | 0.0032 | 0.56 | 0.26 | 742 |
| | O | 0.06 | 0.08 | 0.51 | 7.50 | 1.05 | 0.59 | 0.032 | — | 0.055 | — | — | 0.0025 | 0.009 | 0.003 | 0.0045 | 0.72 | 0.31 | 754 |
| | P | 0.07 | 0.12 | 0.86 | 4.10 | 0.65 | 0.43 | 0.030 | 0.98 | — | — | — | 0.0041 | 0.007 | 0.003 | 0.0042 | 0.57 | 0.30 | 798 |
| | Q | 0.05 | 0.25 | 1.22 | 3.48 | 0.57 | 0.50 | 0.041 | — | — | — | 0.010 | 0.0035 | 0.007 | 0.002 | 0.0035 | 0.59 | 0.24 | 840 |
| | R | 0.06 | 0.05 | 0.52 | 2.52 | 1.15 | 0.63 | 0.045 | 0.25 | 0.083 | — | 0.012 | 0.0027 | 0.004 | 0.002 | 0.0026 | 0.63 | 0.26 | 892 |

TABLE 1-continued

| | Steel | C | Si | Mn | Ni | Mo | Cr | Sol.Al | Cu | V | Nb | Ti | Ca | P | S | N | Ceq | Pcm | $Ac_3$ |
|---|---|---|---|---|---|---|---|---|---|---|---|---|---|---|---|---|---|---|---|
| | | (wt %) | | | | | | | | | | | | | | | | | |
| | S | 0.04 | 0.11 | 0.48 | 3.12 | 1.03 | 0.51 | 0.025 | — | 0.063 | 0.008 | 0.009 | 0.0032 | 0.003 | 0.002 | 0.0020 | 0.57 | 0.22 | 883 |
| | T | 0.03 | 0.05 | 0.50 | 7.92 | 0.65 | 0.50 | 0.030 | — | 0.110 | 0.012 | — | 0.0027 | 0.007 | 0.003 | 0.0042 | 0.58 | 0.27 | 747 |
| | U | 0.06 | 0.12 | 0.53 | 5.25 | 0.58 | 0.56 | 0.034 | 0.20 | 0.061 | 0.008 | 0.008 | 0.0020 | 0.008 | 0.002 | 0.0026 | 0.55 | 0.26 | 797 |
| Com- | V | 0.12 | 0.05 | 0.58 | 5.03 | 0.60 | 0.58 | 0.036 | — | 0.060 | — | — | — | 0.006 | 0.001 | 0.0036 | 0.61 | 0.31 | 772 |
| para- | W | 0.13 | 0.25 | 0.63 | 3.55 | 0.51 | 0.54 | 0.029 | — | 0.050 | — | — | — | 0.008 | 0.002 | 0.0040 | 0.57 | 0.30 | 817 |
| tive | X | 0.12 | 0.08 | 0.55 | 8.35 | 1.10 | 0.52 | 0.032 | — | 0.048 | — | — | — | 0.004 | 0.001 | 0.0028 | 0.80 | 0.39 | 703 |

(Note) Ceq (%) = C + Si /24 + Mn /6 + Ni /40 + Cr /5 + Mo /4 + V /14
(Note) Pcm (%) = C + Si /30 + Mn /20 + Cu /20 + Ni /60 + Cr /20 + Mo /15 + V /10 + 5B
(Note) $Ac_3$ (°C.) = 937.2 − 476.5 × % C + 56.0 × % Si − 19.7 × % Mn − 16.3 × % Cu − 26.6 × % Ni − 4.9 × Cr + 38.1 × % Mo + 124.8 × % V + 136.3 × % Ti + 35.0 × % Zr − 19.1 × % Nb + 198.4 × % Al + 3315.0 × % B (Miyoshi et al. "Tetsu to Hagane" No. 51 (1965) p. 2006)

TABLE 2

| | Process No. | Heating, Hot-Rolling, Water Cooling (Direct Quenching) Conditions: Slab Heating Temp. (°C.) | Recrystallization Zone Rolling Initiation Temp. (°C.) | Recrystallization Zone Rolling Reduction (%) | Unrecrystallization Zone Rolling Initiation Temp. (°C.) | Unrecrystallization Zone Rolling Reduction (%) | Water Cooling Initiation Temp. (°C.) | Water Cooling Termination Temp. (°C.) | Reheating Quenching Reheating Quenching Temp. (°C.) | Tempering Tempering Temp. (°C.) |
|---|---|---|---|---|---|---|---|---|---|---|
| In- | 1 | 1150 | 980 | 56 | 850 | 43 | 835 | Room Temp. | 930 | 590 |
| ven- | 2 | 1150 | 940 | 56 | 825 | 43 | 810 | " | 880 | 600 |
| tion | 3 | 1150 | 950 | 53 | 840 | 38 | 820 | " | 820 | 600 |
| | 4 | 1150 | 950 | 27 | 800 | 64 | 660 | " | 790 | 560 |
| | 5 | 1150 | 950 | 57 | 850 | 33 | 840 | Room Temp. | 890 | 620 |
| | 6 | 1050 | 930 | 53 | 860 | 38 | 835 | 50 | 880 | 620 |
| | 7 | 1200 | 950 | 86 | 845 | 43 | 830 | Room Temp. | 820 | 590 |
| | 8 | 1250 | 950 | 50 | 850 | 50 | 835 | 50 | 910 | 600 |
| | 9 | 1100 | 960 | 40 | 865 | 38 | 840 | " | 890 | 620 |
| | 10 | 1000 | 930 | 25 | 820 | 50 | 810 | 50 | 820 | 590 |
| | 11 | 1150 | 940 | 25 | 840 | 35 | 830 | 100 | 800 | 575 |
| | 12 | 1100 | 950 | 56 | 820 | 43 | 800 | Room Temp. | 850 | 600 |
| | 13 | 1150 | 950 | 56 | 835 | 33 | 810 | " | 880 | 600 |
| | 14 | 1000 | 920 | 40 | 800 | 38 | 790 | 50 | 800 | 580 |
| | 15 | 1100 | 900 | 53 | 750 | 38 | 690 | 100 | 800 | 570 |
| | 16 | 1050 | 950 | 56 | 850 | 43 | 830 | Room Temp. | 850 | 600 |
| | 17 | 1200 | 980 | 56 | 830 | 43 | 815 | " | 880 | 620 |
| | 18 | 1150 | 950 | 25 | 845 | 35 | 830 | " | 900 | 600 |
| | 19 | 1100 | 960 | 25 | 840 | 50 | 820 | " | 900 | 600 |
| | 20 | 1100 | 950 | 56 | 800 | 38 | 790 | Room Temp. | 800 | 565 |
| | 21 | 1150 | 950 | 25 | 830 | 50 | 820 | 100 | 850 | 580 |
| Com- | 22 | 1100 | 930 | 70 | — | — | 900 | " | 900 | 600 |
| para- | 23 | 1050 | 920 | 11 | 850 | 75 | 830 | 50 | — | 600 |
| tive | 24 | 1100 | 900 | 56 | 800 | 38 | 790 | " | 920 | 615 |
| | 25 | 1150 | 950 | 73 | (Air Cooling after Finishing Rolling) | | | | 910 | 620 |
| | 26 | 1150 | 950 | 11 | 850 | 75 | 840 | Room Temp. | — | 620 |
| | 27 | 1100 | 950 | 56 | 800 | 38 | 785 | 100 | 900 | 570 |

TABLE 3

| | Process No. | Steel | Plate Thickness | Position along Thickness | Test Direction | Tensile Property (Parent Metal) YS (Kgf/mm²) | TS (kgf/mm²) | Impact Toughness (Parent Metal) EL. (%) | vTrs (°C.) | vE-60 (kgf-m) | Parent Metal $K_{iscc}$ (kgf/mm$^{-3/2}$) | Has $K_{iscc}$ (kgf/mm$^{-3/2}$) | Difference |
|---|---|---|---|---|---|---|---|---|---|---|---|---|---|
| In- | 1 | A | 40 | S | L | 96.4 | 102.2 | 26 | −135 | 24.2 | — | — | |
| ven- | | | | 7 mm | T | 96.7 | 102.7 | 25 | −130 | 23.1 | | | |
| tion | | | | ½ t | L | 95.2 | 101.3 | 25 | −125 | 23.8 | | | |
| | | | | | T | 95.6 | 101.6 | 24 | −125 | 22.4 | | | |
| | 2 | B | 40 | S | L | 87.2 | 92.7 | 24 | −145 | 25.4 | 580 | 520 | |
| | | | | 7 mm | t | 87.7 | 92.9 | 24 | −145 | 23.8 | | | |
| | | | | ½ t | L | 87.1 | 92.2 | 25 | −140 | 24.3 | | | |
| | | | | | T | 87.4 | 92.5 | 25 | −140 | 24.1 | | | |
| | 3 | T | 50 | S | L | 90.6 | 95.2 | 24 | −155 | 28.6 | 600 | 510 | |
| | | | | 7 mm | T | 90.8 | 95.3 | 24 | −145 | 28.2 | | | |
| | | | | ½ t | L | 90.2 | 94.3 | 24 | −150 | 26.8 | | | |
| | | | | | T | 90.5 | 94.6 | 23 | −145 | 25.8 | | | |
| | 4 | D | 40 | S | L | 108.2 | 114.5 | 23 | −150 | 26.2 | >650 | >650 | |
| | | | | 7 mm | T | 108.7 | 114.9 | 23 | −140 | 25.0 | | | |
| | | | | ½ t | L | 107.3 | 113.5 | 24 | −145 | 25.7 | | | |
| | | | | | T | 107.4 | 113.2 | 23 | −140 | 24.2 | | | |
| | 5 | E | 40 | S | L | 89.3 | 92.5 | 24 | −160 | 29.8 | 600 | 530 | |
| | | | | 7 mm | T | 88.7 | 92.3 | 24 | −150 | 28.5 | | | |
| | | | | ½ t | L | 87.7 | 92.0 | 23 | −160 | 30.1 | | | |
| | | | | | T | 88.8 | 92.2 | 23 | −150 | 29.3 | | | |
| | 6 | F | 50 | S | L | 86.2 | 91.7 | 24 | −120 | 23.5 | — | — | |

TABLE 3-continued

| | Process No. | Steel | Plate Thickness | Position along Thickness | Test Direction | Tensile Property (Parent Metal) YS (Kgf/mm²) | TS (kgf/mm²) | Impact Toughness (Parent Metal) EL. (%) | vTrs (°C.) | vE-60 (kgf-m) | Parent Metal $K_{iscc}$ (kgf/mm$^{-3/2}$) | Has $K_{iscc}$ (kgf/mm$^{-3/2}$) | Difference |
|---|---|---|---|---|---|---|---|---|---|---|---|---|---|
| | | | | 7 mm | T | 86.9 | 92.2 | 24 | −110 | 22.8 | | | |
| | | | | ½ t | L | 86.2 | 91.1 | 23 | −115 | 23.5 | | | |
| | | | | | T | 86.5 | 91.8 | 23 | −110 | 22.4 | | | |
| | 7 | G | 40 | S | L | 85.4 | 91.6 | 25 | −140 | 25.8 | — | — | |
| | | | | 7 mm | T | 85.7 | 92.3 | 25 | −135 | 25.4 | | | |
| | | | | ½ t | L | 84.2 | 90.1 | 24 | −130 | 25.0 | | | |
| | | | | | T | 84.8 | 90.5 | 24 | −120 | 23.8 | | | |
| | 8 | H | 50 | S | L | 96.8 | 102.7 | 25 | −130 | 24.9 | — | — | |
| | | | | 7 mm | T | 96.8 | 102.8 | 25 | −120 | 23.7 | | | |
| | | | | ½ t | L | 96.3 | 102.4 | 24 | −125 | 24.0 | | | |
| | | | | | T | 96.5 | 102.7 | 24 | −120 | 23.5 | | | |
| | 9 | I | 75 | S | L | 91.3 | 94.9 | 24 | −140 | 25.7 | 580 | 540 | |
| | | | | 7 mm | T | 91.6 | 95.2 | 24 | −135 | 25.8 | | | |
| | | | | ½ t | L | 90.8 | 94.4 | 23 | −135 | 26.2 | | | |
| | | | | | T | 91.2 | 94.7 | 23 | −130 | 25.0 | | | |
| | 10 | J | 100 | S | L | 98.2 | 102.9 | 24 | −150 | 30.2 | >650 | 550 | |
| | | | | 7 mm | T | 98.5 | 103.2 | 23 | −145 | 29.7 | | | |
| | | | | ½ t | L | 96.8 | 102.4 | 24 | −145 | 28.9 | | | |
| | | | | | T | 97.6 | 102.7 | 23 | −140 | 28.4 | | | |
| | 11 | K | 130 | S | L | 104.2 | 110.4 | 24 | −150 | 24.8 | 550 | 52 | |
| | | | | 7 mm | T | 104.5 | 110.8 | 24 | −150 | 24.5 | | | |
| | | | | ½ t | L | 103.3 | 109.4 | 25 | −140 | 23.4 | | | |
| | | | | | T | 103.6 | 109.7 | 24 | −140 | 23.6 | | | |
| | 12 | L | 40 | S | L | 94.4 | 99.5 | 23 | −135 | 25.7 | — | — | |
| | | | | 7 mm | T | 94.6 | 99.8 | 24 | −130 | 25.2 | | | |
| | | | | ½ t | L | 93.3 | 98.4 | 23 | −130 | 26.3 | | | |
| | | | | | T | 93.2 | 98.7 | 23 | −125 | 25.8 | | | |
| | 13 | M | 40 | S | L | 88.2 | 92.2 | 24 | −145 | 24.9 | 620 | 580 | |
| | | | | 7 mm | T | 88.6 | 92.5 | 24 | −145 | 24.5 | | | |
| | | | | ½ t | L | 88.1 | 92.4 | 25 | −140 | 23.3 | | | |
| | | | | | T | 88.3 | 92.7 | 24 | −140 | 23.1 | | | |
| | 14 | N | 75 | S | L | 89.4 | 94.8 | 24 | −145 | 27.8 | — | — | |
| | | | | 7 mm | T | 89.8 | 95.2 | 24 | −145 | 27.4 | | | |
| | | | | ½ t | L | 88.4 | 93.0 | 25 | −140 | 26.7 | | | |
| | | | | | T | 88.6 | 93.3 | 25 | −135 | 26.2 | | | |
| | 15 | O | 50 | S | L | 109.2 | 116.0 | 24 | −155 | 25.7 | 550 | 540 | |
| | | | | 7 mm | T | 190.8 | 116.4 | 25 | −150 | 25.2 | | | |
| | | | | ½ t | L | 107.1 | 115.3 | 25 | −145 | 24.8 | | | |
| | | | | | T | 107.3 | 115.4 | 25 | −140 | 24.6 | | | |
| | 16 | P | 40 | S | L | 90.6 | 95.6 | 23 | −130 | 23.8 | — | — | |
| | | | | 7 mm | T | 90.8 | 95.5 | 23 | −135 | 23.6 | | | |
| | | | | ½ t | L | 90.4 | 95.2 | 23 | −135 | 23.5 | | | |
| | | | | | T | 90.6 | 95.3 | 23 | −130 | 22.8 | | | |
| | 17 | Q | 40 | S | L | 86.5 | 92.6 | 24 | −135 | 24.2 | — | — | |
| | | | | 7 mm | T | 86.7 | 92.8 | 23 | −125 | 23.5 | | | |
| | | | | ½ t | L | 86.1 | 92.0 | 23 | −130 | 23.8 | | | |
| | | | | | T | 86.3 | 92.2 | 24 | −125 | 22.9 | | | |
| | 18 | R | 130 | S | L | 104.8 | 111.4 | 24 | −120 | 23.0 | 600 | 550 | |
| | | | | 7 mm | T | 105.2 | 111.8 | 24 | −120 | 22.7 | | | |
| | | | | ½ t | L | 104.0 | 110.9 | 23 | −110 | 21.7 | | | |
| | | | | | T | 104.5 | 111.2 | 23 | −100 | 21.4 | | | |
| | 19 | S | 100 | S | L | 98.6 | 103.5 | 23 | −135 | 23.7 | — | — | |
| | | | | 7 mm | T | 98.7 | 103.7 | 23 | −125 | 22.8 | | | |
| | | | | ½ t | L | 97.3 | 102.0 | 23 | −130 | 23.5 | | | |
| | | | | | T | 97.8 | 102.4 | 24 | −125 | 22.5 | | | |
| | 20 | T | 50 | S | L | 101.3 | 106.2 | 24 | −150 | 28.6 | >650 | 600 | |
| | | | | 7 mm | T | 101.5 | 106.3 | 24 | −145 | 27.4 | | | |
| | | | | ½ t | L | 100.8 | 105.9 | 22 | −140 | 27.2 | | | |
| | | | | | T | 100.9 | 106.0 | 23 | −140 | 27.0 | | | |
| | 21 | U | 100 | S | L | 89.0 | 96.5 | 24 | −145 | 25.5 | — | — | |
| Comparative | 22 | V | 75 | S | L | 96.3 | 103.5 | 24 | −60 | 8.7 | 400 | 290 | High C |
| | | | | 7 mm | T | 96.5 | 103.2 | 24 | −60 | 8.2 | | | No reduction for |
| | | | | ½ t | L | 90.2 | 97.3 | 23 | −95 | 15.8 | | | Unrecrystallzation |
| | | | | | T | 90.4 | 97.5 | 24 | −85 | 14.5 | | | Zone Rolling |
| | | | | | | | | | | | | | High Temp. for Reheating Quenching |
| | 23 | W | 40 | S | L | 96.8 | 101.9 | 24 | −110 | 21.4 | 330 | 270 | High C |
| | | | | 7 mm | T | 104.2 | 109.6 | 21 | −80 | 12.5 | | | Big reduction for |
| | | | | ½ t | L | 96.5 | 100.3 | 23 | −95 | 16.6 | | | Unrecrystallzation |
| | | | | | T | 103.4 | 107.2 | 20 | −70 | 9.8 | | | Zone Rolling |
| | | | | | | | | | | | | | No Reheating Quenching |
| | 24 | X | 50 | S | L | 100.8 | 109.5 | 23 | −75 | 9.5 | 380 | 220 | High C, Ni |
| | | | | 7 mm | T | 99.5 | 107.9 | 23 | −60 | 7.8 | | | High Temp. for Re- |
| | | | | ½ t | L | 96.5 | 105.2 | 24 | −90 | 13.9 | | | heating Quenching |

TABLE 3-continued

| Process No. | Steel | Plate Thickness | Position along Thickness | Test Direction | Tensile Property (Parent Metal) YS (Kgf/mm²) | TS (kgf/mm²) | Impact Toughness (Parent Metal) EL. (%) | vTrs (°C.) | vE-60 (kgf-m) | Parent Metal $K_{iscc}$ (kgf/mm$^{-3/2}$) | Has $K_{iscc}$ (kgf/mm$^{-3/2}$) | Difference |
|---|---|---|---|---|---|---|---|---|---|---|---|---|
| | | | | T | 95.8 | 106.3 | 24 | −85 | 12.4 | | | |
| 25 | E | 40 | S | L | 84.2 | 88.7 | 23 | −100 | 20.8 | — | — | Air Cooling after |
| | | | 7 mm | T | 84.5 | 89.6 | 22 | −80 | 13.4 | | | Finishing Rolling |
| | | | ½ t | L | 83.7 | 89.2 | 22 | −90 | 15.6 | | | |
| | | | | T | 84.8 | 88.5 | 20 | −60 | 7.3 | | | |
| 26 | E | 40 | S | L | 80.1 | 84.5 | 22 | −125 | 21.6 | 405 | — | Big reduction for |
| | | | 7 mm | T | 86.3 | 90.5 | 20 | −90 | 16.8 | | | Unrecrystalliaz- |
| | | | ½ t | L | 79.2 | 83.2 | 23 | −120 | | | | tion Zone Rolling |
| | | | | T | 85.5 | 89.8 | 20 | −80 | 15.2 | | | No Reheating Quenching |
| 27 | T | 50 | S | L | 94.7 | 98.2 | 24 | −85 | 17.6 | — | — | High Temp. for Re- |
| | | | 7 mm | T | 93.8 | 97.5 | 23 | −80 | 16.4 | | | heating Quenching |
| | | | ½ t | L | 92.4 | 96.8 | 23 | −120 | 21.7 | | | |
| | | | | T | 90.8 | 95.5 | 23 | −100 | 20.3 | | | |

Note:
(1) S in the "Position Along Thickness" column means "Surface Layer Portion", i.e., a position 7 mm deep from plate surface.
(2) $K_{iscc}$ test pieces of the parent metal are notched at the T-direction of the ½ t part and HAZ $K_{iscc}$ test pieces are notched at the center of HAZ and subjected to a dead-weight test in 3.5% NaCl artificial seawater respectively.

We claim:

1. A process for producing high toughness, high strength steel having good resistance to stress corrosion cracking, comprising the steps of:

preparing a steel slab comprised of 0.02 to 0.10 wt% C., 0.50 wt% or less Si, 0.4 to 1.5 wt% Mn, 1.0 to 8.0 wt% Ni, 0.1 to 1.5 wt% Mo, 1.8 wt% or less Cr, 0.01 to 0.08 wt% sol. Al, with the balance of Fe and unavoidable impurities;

heating the steel to a temperature of from 1000° C. to 1250° C. ;

hot rolling the steel at a reduction rate of 20 to 60% at an austenite recrystallization temperature regions then at a reduction rate of 30 to 70% at an austenite nonrecrystallization temperature region, and finishing the rolling at a temperature of 650° C. or higher;

quenching the steel by initiating water cooling at a temperature at or above the $A_{r3}$ point thereof and terminating the water cooling at a temperature of 150° C. or lower;

quenching the steel after reheating the steel to a temperature between the $A_{c3}$ point and the $A_{c3}$ point +100° C. thereof; and tempering the steel at a temperature at or below the $A_{c1}$ point thereof.

2. A process according to claim 1, wherein the steel includes one or more of: 1.5wt% or less Cu, 0.12 wt% or less V, 0.04 wt% or less Nb, and 0.015 wt% or less Ti.

3. A process according to claim 1, wherein the steel includes 0.0050 wt% or less Ca.

4. A process according to claim 1, wherein the steel includes one or more of: 1.5 wt% or less Cu, 0.12 wt% or less V, 0.04 wt% or less Nb, 0.015 wt% or less Ti, and 0.0050 wt% or less Ca.

* * * * *